United States Patent [19]

Howden

[11] Patent Number: 4,665,336

[45] Date of Patent: May 12, 1987

[54] MEANS FOR COOLING THE FACEPLATE OF A CATHODE RAY TUBE IN A TELEVISION PROJECTION SYSTEM

[75] Inventor: Harry Howden, Smallfield, England

[73] Assignee: U.S. Philips Corporation, New York, N.Y.

[21] Appl. No.: 849,349

[22] Filed: Apr. 7, 1986

Related U.S. Application Data

[63] Continuation of Ser. No. 564,632, Dec. 22, 1983, abandoned.

[30] Foreign Application Priority Data

Dec. 22, 1982 [GB] United Kingdom ..... 8236367

[51] Int. Cl.[4] ..... H01J 29/89; H01J 7/24

[52] U.S. Cl. ..... 313/36; 313/12; 313/44; 313/478

[58] Field of Search ..... 313/477 R, 478, 12, 313/36, 44; 358/247, 253; 165/46

[56] References Cited

U.S. PATENT DOCUMENTS

| | | | |
|---|---|---|---|
| 1,955,899 | 4/1934 | Zworykin | 313/36 X |
| 2,093,288 | 9/1937 | Ogloblinsky | 358/237 X |
| 2,517,774 | 8/1950 | Epstein | 358/250 |
| 3,914,010 | 10/1975 | Zeller | 313/12 X |
| 4,213,498 | 7/1980 | Vandenbossche | 165/46 X |

*Primary Examiner*—Palmer C. DeMeo
*Attorney, Agent, or Firm*—F. Brice Faller

[57] ABSTRACT

For cooling the faceplate of a high-energy cathode ray tube in an in-line television projection system, a cooling cell (5) constructed as a separate entity is interposed between the CRT faceplate (2) and the transmission lens (3) which is arranged in front of and in line with the cathode ray (1). The cooling cell comprises two flexible transparent diaphragms (6 and 7) which are connected at their peripheries to form an enclosure (8) for containing a cooling liquid and which are arranged in contact with the front surface 2*a* of the CRT faceplate and the rear surface (4) of the lens. The cooling cell has an inlet (11) and an outlet (12) through which circulating liquid enters and leaves the cell.

4 Claims, 3 Drawing Figures

MEANS FOR COOLING THE FACEPLATE OF A CATHODE RAY TUBE IN A TELEVISION PROJECTION SYSTEM

This is a continuation of application Ser. No. 564,632, filed Dec. 22, 1983, now abandoned.

BACKGROUND OF THE INVENTION

The invention relates to means for cooling the faceplate of the cathode ray tube in an in-line projection system for a television receiver. Such a system (hereinafter referred to as ("a television projection system of the kind described") comprises a transmission lens arranged in front of and in line with a cathode ray tube.

It is known in such projection systems to use a liquid to dissipate the heat generated by the very bright, high-energy cathode ray tubes employed in these systems. The liquid, interposed between the transmission lens and the CRT (cathode ray tube) faceplate, also serves to improve picture brightness by eliminating the glass-to-air optical interfaces formed at the rear surfaces of the lens and the front surface of the CRT faceplate. It also avoids the need to work these surfaces to optical flatness. In one known arrangement, described in British Patent Specification No. 417,435, liquid is contained in a space which is bounded on two opposite sides by the lens and the CRT faceplate, respectively, and around the periphery by a rigid collar having an inlet and an outlet for circulation of the liquid for cooling purposes. With this arrangement, due to the presence of the rigid collar, which is fixed to the lens and to the cathode ray tube, it is not possible to adjust the whole lens axially relative to the tube to focus the projected image onto the screen of the television receiver. To permit such adjustment it has been proposed to use a corrugated flexible bellows in place of the rigid collar. This does not, however, obviate a further disadvantage of the known arrangement, which is that, in cases where the lens is to be made of a plastics material, the lens maker is limited to a choice of such materials which are compatible with the cooling liquid. This drawback is avoided in another proposed arrangement in which a chamber for containing cooling liquid is formed between the CRT faceplate and a glass plate which is spaced from the front of the faceplate and is connected to the faceplate by a peripheral wall. This arrangement, however, leaves glass-to-air interfaces at the front of the glass plate and the rear of the lens, resulting in loss of light and, therefore, picture brightness due to surface reflection.

A further drawback common to all these arrangements is that the space for containing the cooling liquid, since it is partially bounded by the CRT faceplate or by the faceplate and the lens, has to be formed during the manufacture of the cathode ray tube or during the assembly of the tube and the lens, with the result that these activities become more complicated and require the provision of additional on-site skills and facilites. It is an object of the invention to provide a cooling means which does not suffer from this drawback.

SUMMARY OF THE INVENTION

According to the invention there is provided a means for cooling the faceplate of the cathode ray tube in a television projection system of the kind described, said means comprising a cooling cell which is constructed to be interposed between the front surface of the faceplate of the cathode ray tube and the rear surface of the transmission lens of the projection system and which comprises two flexible transparent diaphragms connected at their peripheries to form an enclosure for containing a cooling liquid, an inlet and an outlet being provided at the periphery of the enclosure through which liquid can enter and leave the enclosure.

The invention also provides a television projection system of the kind described comprising a cooling means according to the invention, the cooling cell being interposed between the cathode ray tube and the transmission lens with the outer surfaces of the diaphragms in contact with the front surface of the faceplate of the tube and the rear surface of the lens, respectively.

The inlet and outlet of the cooling cell may be connected to a heat-dissipating device which forms with the cooling cell a closed circulating system, the system containing a cooling liquid having a refractive index which matches that of the material of the faceplate of the cathode ray tube.

The cooling cell forms a separate entity which can be produced independently of the cathode ray tube and the transmission lens. The component parts of the projection system can thus be manufactured independently of one another in areas of different skills and brought together for assembly. The assembly simply entails positioning the cooling cell between the cathode ray tube and the lens and moving the tube and the lens axially relative to one another to bring the front surface of the faceplate of the tube and the rear surface of the lens into contact with the outer surfaces of the two flexible diaphragms forming the walls of the cooling cell. The flexibility of these walls permits subsequent axial adjustment of the lens relative to the cathode ray tube to focus the projected image onto the screen of the television receiver in which the projection system is fitted.

The construction of the cooling means as a separate entity has the further advantage of facilitating the service replacement of individual parts of the projection system.

Another advantage of the cooling means according to the invention over the known cooling means is that, in the event of the faceplate of the cathode ray tube cracking, there is no danger of cooling liquid leaking into the tube.

For ease and inexpensiveness of manufacture, the diaphragms forming the walls of the cooling cell may be made of a transparent plastics material having a refractive index which matches that of the material of the faceplate of the cathode ray tube.

In a simple embodiment of the television projection system according to the invention, the inlet and outlet of the cooling cell are connected to a heat-dissipating device which forms with the cooling cell a closed circulating system, which system contains a cooling liquid having a refractive index which matches that of the material of the faceplate of the cathode ray tube.

FIG. 1 is a sectional view of a cooling cell constructed in accordance with the invention, the section being taken on the line I—I in FIG. 2 and the cell being shown positioned between a cathode ray tube and a transmission lens in an initial stage in the assembly of the cell in a television projection system, FIG. 2 is a sectional view taken on the line II—II in FIG. 1, and FIG. 3 is a view similar to FIG. 1 showing the assembly of the projection system completed.

DESCRIPTION OF THE PREFERRED EMBODIMENT

Figure 3:
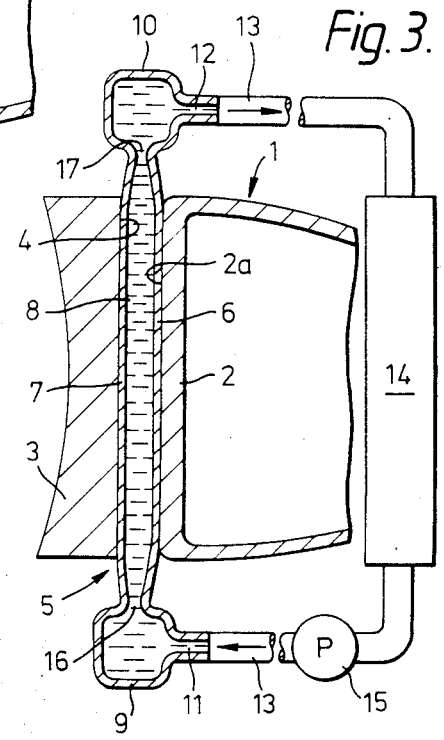
Figure 2:
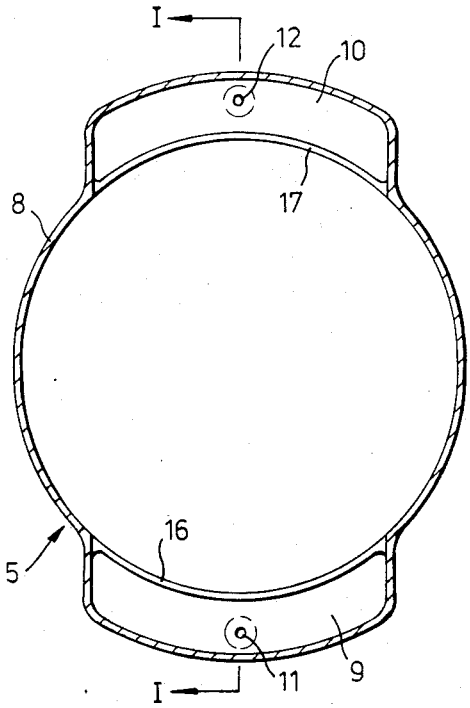

Reference is made first to FIG. 3 in which there is shown part of the glass envelope 1 of the cathode ray tube of an in-line projection system for a television receiver. The envelope has a flat faceplate 2. The projection system further comprises a transmission lens which is arranged in front of and in line with the cathode ray tube and of which only the rear element 3 is shown. This element has a flat rear surface 4. The lens may be a 3- to 5-element aspheric lens, for example.

Interposed between the CRT faceplate 2 and the rear lens element 3 is a cooling cell 5 comprising two compliantly flexible transparent diaphragms 6 and 7 which are rigidly connected at their peripheries to form a compliant enclosure 8 for containing a cooling liquid. At diametrically opposed regions on the periphery of the enclosure are inlet and outlet chambers 9 and 10, respectively, having inlet and outlet ports 11 and 12, respectively. These ports are adapted to be connected by pipes 13 to a heat-dissipating radiator 14 through which liquid can be circulated by a pump 15 or by thermo-syphonic action. The interior of the enclosure 8 is in open communication with the interiors of the inlet and outlet chambers via elongate apertures 16 and 17.

Figure 1:
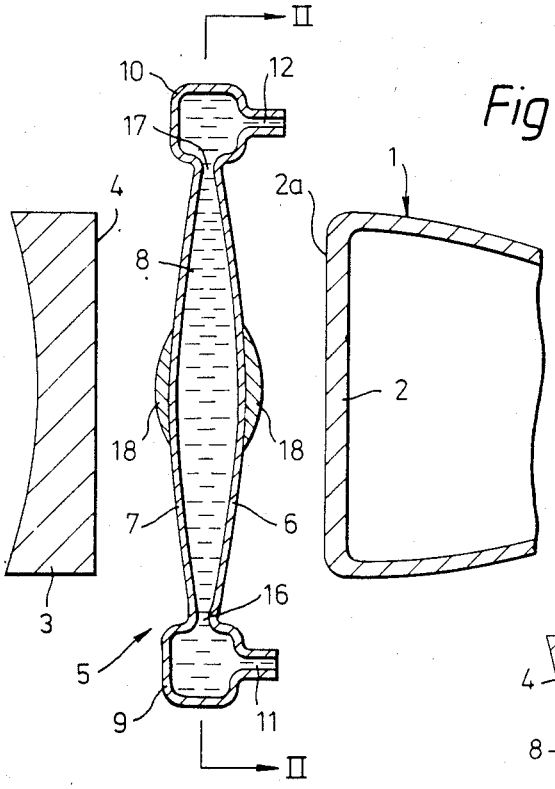

In the assembly of the projection system, first the cathode ray tube and the transmission lens are arranged in line with one another and with sufficient space between them to allow the cooling cell 5 to be positioned freely between the CRT faceplate 2 and the rear lens element 3, as shown in FIG. 1. In this initial stage, the diaphragms 6 and 7 forming the walls of the cooling cell are slightly distended under the pressure of liquid in the cell, the inlet and outlet ports 11 and 12 of the cell having been connected to the radiator 14 which, with the cooling cell and the connecting pipes 13, forms a closed circulating system. After applying a small quantity of a non-volatile liquid 18 to the outer surface of each of the diaphragms 6 and 7 at the center thereof, the cathode ray tube and the transmission lens are moved axially towards one another to bring the front surface 2*a* of the CRT faceplate 2 and the rear surface 4 of the lens element 3 into contact with the outer surfaces of the diaphragms 6 and 7, respectively. The compliantly flexible diaphragms 6, 7 conform to the surfaces 2*a*, 4 respectively. The movement of the tube and the lens is continued until the distance between their adjacent surfaces 2*a* and 4 is reduced to a predetermined value which is governed by the chosen optical design of the system and which is typically 2.0 mm.

The refractive index of the cooling liquid should match as closely as possible that of the glass of which the CRT faceplate is made. This glass is usually of a "non-browning" variety, in which case glycerol would be a suitable choice for the cooling liquid. The material of which the diaphragms 6 and 7 are made, which may be a transparent plastics material, should also match the refractive index of the glass of the CRT faceplate, as, of course, should the material of the rear lens element 3.

The choice of cooling liquid will also be influenced by, inter alia, the rate at which heat is to be removed from the CRT faceplate by the liquid, which will determine such characteristics as the viscosity of the liquid. The cooling liquid, and also the material of the diaphragams 6 and 7, must also be selected for minimum degradation from CRT radiations.

An efficient optical contact between the contiguous surfaces of the diaphragms 6 and 7 and the CRT faceplate 2 and rear lens element 3 is ensured by the liquid 18 on the outer surfaces of the diaphragms. As the faceplate 2 and the lens element 3 press against the diaphragms during the movement of the cathode ray tube and the transmission lens toward one another in the assembly of the projection system, this liquid is squeezed out over the outer surfaces of the diaphragms and the surfaces 2*a* and 4 of the faceplate 2 and lens element 3 and eliminates the glass-to-air and plastic-to-air interfaces formed at these surfaces.

When the assembly of the projection system has been completed and the system has been fitted in the television receiver, due to the flexibility of the diaphragms 6 and 7, the transmission lens can be readily axially adjusted relative to the cathode ray tube to focus the projected image onto the screen of the receiver.

I claim:

1. A television projection system comprising a cathode ray tube having a faceplate with a front surface, a transmission lens having a rear lens element with a rear surface, said rear surface facing said front surface of said faceplate, a cooling cell interposed between said cathode ray tube and said transmission lens, said cell comprising two compliantly flexible diaphragms joined about their peripheries to form a compliant enclosure therebetween, one diaphragm conforming to the front surface of the faceplate, the other diaphragm conforming to the rear surface of the rear lens element.

2. A system as in claim 1, wherein said cell contains a liquid under pressure.

3. A system as in claim 1, further comprising a small quantity of nonvolatile liquid between each diaphragm and the respective surface against which it is disposed, said liquid providing optical contact between the cooling cell and the tube, as well as between the cooling cell and the rear lens.

4. A system as in claim 1, wherein inlet and outlet means are provided on the periphery of said diaphragms for inlet and discharge of a cooling fluid to and from said enclosure.

* * * * *